United States Patent [19]

Kuhl et al.

[11] 4,232,207

[45] Nov. 4, 1980

[54] ROTARY SWITCH ASSEMBLY

[75] Inventors: Bernhard R. Kuhl, Mount Prospect; Edward J. Safranek, Arlington Heights, both of Ill.

[73] Assignee: The Echlin Manufacturing Company, Branford, Conn.

[21] Appl. No.: 922,091

[22] Filed: Jul. 5, 1978

[51] Int. Cl.[3] ..... H01H 19/54

[52] U.S. Cl. ..... 200/11 R; 200/11 DA; 200/11 G

[58] Field of Search ..... 200/11 R, 11 A, 11 D, 200/11 DA, 11 E, 11 EA, 11 G, 11 J, 11 K, 14, 291

[56] References Cited

U.S. PATENT DOCUMENTS

| | | | |
|---|---|---|---|
| 2,792,549 | 5/1957 | Bernreuter | 324/156 |
| 2,896,033 | 7/1959 | Hartz | 200/11 D |
| 3,188,404 | 6/1965 | Fichter | 200/14 |
| 3,226,991 | 1/1966 | Hartsock | 200/11 DA X |
| 3,270,334 | 8/1966 | Steele, Jr. | 200/11 G X |
| 3,303,296 | 2/1967 | Scott | 200/11 H |
| 3,478,180 | 11/1969 | Bang | 200/14 X |
| 3,518,389 | 6/1970 | Doering, Jr. et al. | 200/11 DA |
| 3,544,896 | 12/1970 | Solow | 324/115 |
| 3,560,672 | 2/1971 | Ludlum et al. | 200/291 X |
| 3,571,534 | 3/1971 | Ashman | 200/11 D |
| 3,594,527 | 7/1971 | Brant et al. | 200/11 G X |
| 3,609,258 | 9/1971 | Leland | 200/11 D |
| 3,734,869 | 5/1973 | Menard et al. | 200/11 DA X |
| 3,736,390 | 5/1973 | Lockard | 200/11 DA |
| 3,924,185 | 12/1975 | Schwartz | 200/11 G X |
| 4,048,560 | 9/1977 | Schwartz | 200/11 G X |

*Primary Examiner*—James R. Scott

*Attorney, Agent, or Firm*—Neuman, Williams, Anderson & Olson

[57] ABSTRACT

A switch mechanism for use with a printed circuit board and for cooperatively operating with an advantageously formed housing to protect such printed circuit board from external forces.

5 Claims, 3 Drawing Figures

ROTARY SWITCH ASSEMBLY

BACKGROUND OF THE INVENTION

This invention relates to electrical switching mechanisms, and more particularly to switching mechanisms for selectively completing electrical circuits printed on a circuit board.

With the advent of printed circuit boards on which a plurality of electrical circuits can be printed quickly, accurately, and inexpensively, it has become desirable to employ versatile and adaptable switching mechanisms which can effect selective completion of electrical circuits by conductively bridging respective gaps between leads on such a printed circuit board. Using such a circuit board in the switching mechanism simplifies the switch mechanism design while eliminating the wiring which would otherwise be required to effect connection from a conventional switch to terminals on the circuit board.

For a circuit board to be employed in a switching mechanism, however, attention must be given to the proper disposition of forces which may be applied to such mechanism, to prevent injury to the circuit board; such forces may otherwise result in damage to the printed leads by cracking the electrically-conductive foil on the board. It is thus desirable to employ a switching mechanism which transfers any such forces through the mechanism to appropriately buttressed force absorbing elements.

Accordingly, it is an object of the present invention to provide an improved, low cost, and simplified switching mechanism for selectively completing electrical circuits on a printed circuit board.

It is another object of this invention to provide a switching mechanism which is substantially insensitive to external forces and does not transfer such forces to a circuit board associated with the switching mechanism.

A still further object of this invention is to provide a versatile switching mechanism for use with a printed circuit board, which mechanism may be easily adapted to different numbers of selectable switch positions.

SUMMARY OF THE INVENTION

In one illustrative embodiment of the invention, these objects are achieved by a switching mechanism which cooperates with a housing and a printed circuit board mounted within the housing. The mechanism is mounted through substantially aligned openings in the housing and circuit board. A detent plate including switch position detents and an upstanding stabilizing collar with a hole therein is secured to the housing with the stabilizing collar substantially aligned with the opening in the housing and with the hole in such collar substantially aligned with the opening in the circuit board. A rotatable switch shaft, of an insulating material, extends through the collar and the opening in the circuit board and includes a radial flange which is seated on the circuit board adjacent the opening therein. A detent arm is secured to the shaft at a point beneath the detent plate for rotation with the shaft and for engaging the detents on the detent plate thereby to define stable rotational positions of adjustment of the shaft. The portion of the shaft which extends through the circuit board opening engages a boss on the housing underlying the circuit board which operates to both limit longitudinal movement of the shaft within the housing and absorb forces applied to the shaft. Electrical contact members secured to the shaft on the underside of the circuit board are rotatable therewith, making contact with arcuate electrical terminals affixed to the circuit board.

Other objects, advantages and features of the invention will become apparent upon reading the following detailed description and appended claims, and upon reference to the following drawings.

BRIEF DESCRIPTION OF THE DRAWINGS

For a complete understanding of this invention, references should now be made to the embodiment illustrated in greater detail in the accompanying drawings, and described below by way of an example of the invention.

In the drawing

DETAILED DESCRIPTION OF THE ILLUSTRATIVE EMBODIMENT

Figure 1:
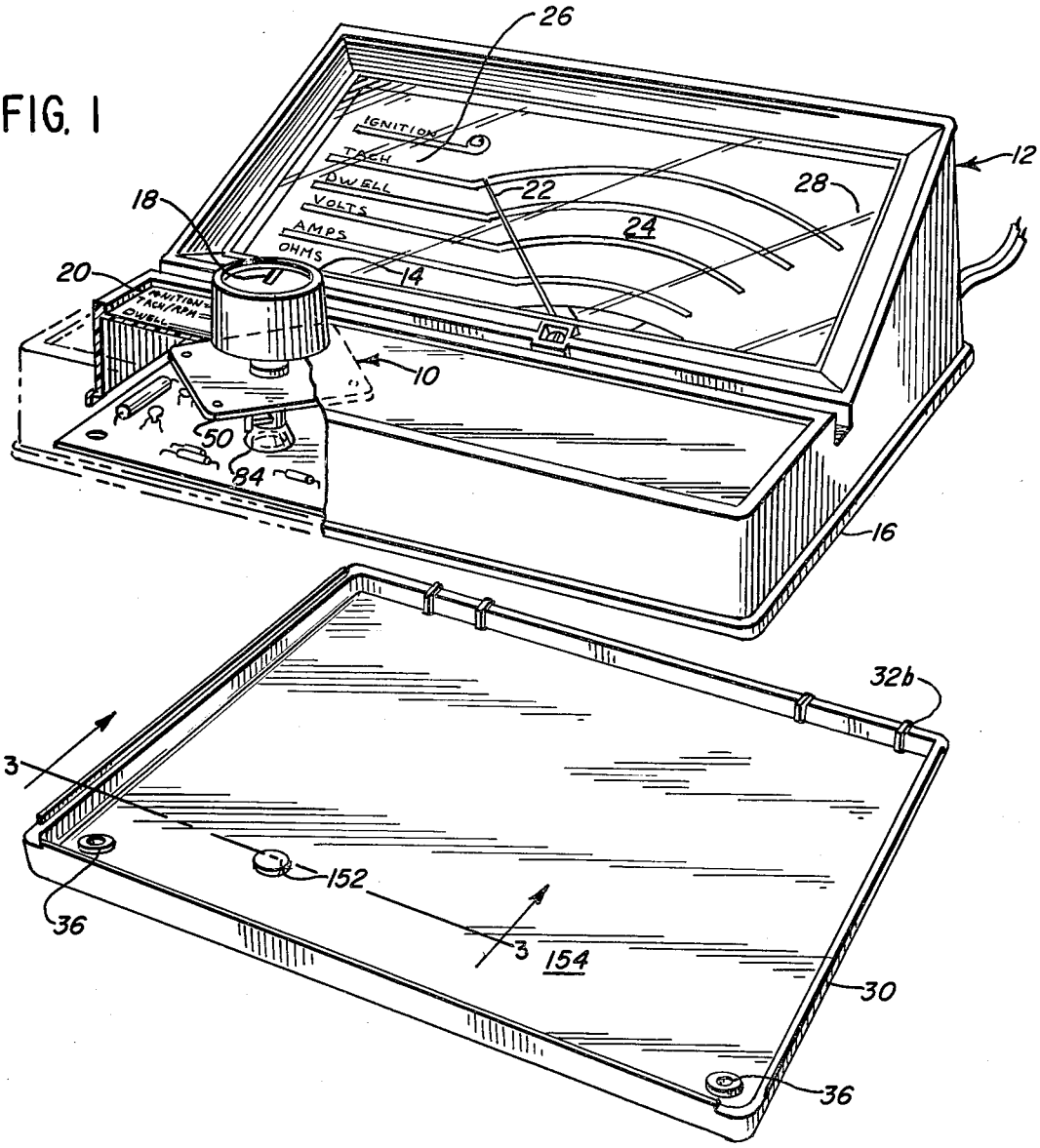
FIG. 1 is a perspective and partial sectional view of the preferred embodiment of the switching mechanism mounted in an electrical meter apparatus, with the lower housing portion of such apparatus shown in exploded relation thereto.

Referring principally to FIG. 1, a switch 10 according to the invention is shown mounted in an electrical meter apparatus 12. The switch includes an indicator knob 4 extending upwardly from an upper housing portion 16, which may be molded and of a suitable plastic material. The knob 14 includes a position indicating marker 18 on its upper surface which indicates the present positioning of the switch apparatus. Such marker is used in reference to legends appearing at 20 on the housing portion 16 to select the function to be performed by the electrical meter apparatus 12. The selected function results in the processing of certain electrical signals obtained by sensors (not shown) to produce a display comprising deflection of a needle 22 across a face 24 of the electrical meter apparatus 12. The deflection indicates the measurement made by the electrical meter apparatus when referred to scales 26 printed on the face 24. Those scales correspond to the function legends 20.

Figure 3:
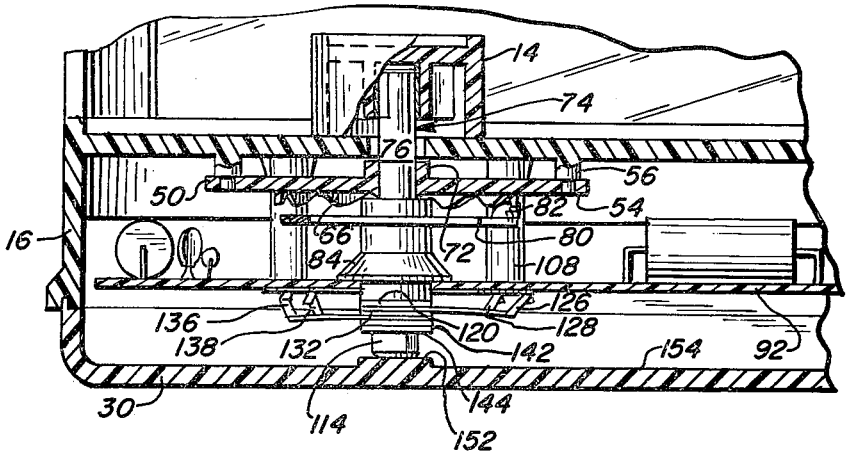
FIG. 3 is a cross-sectional view of the switch mechanism of FIG. 1, taken along line 3–3 thereof.
Figure 2:
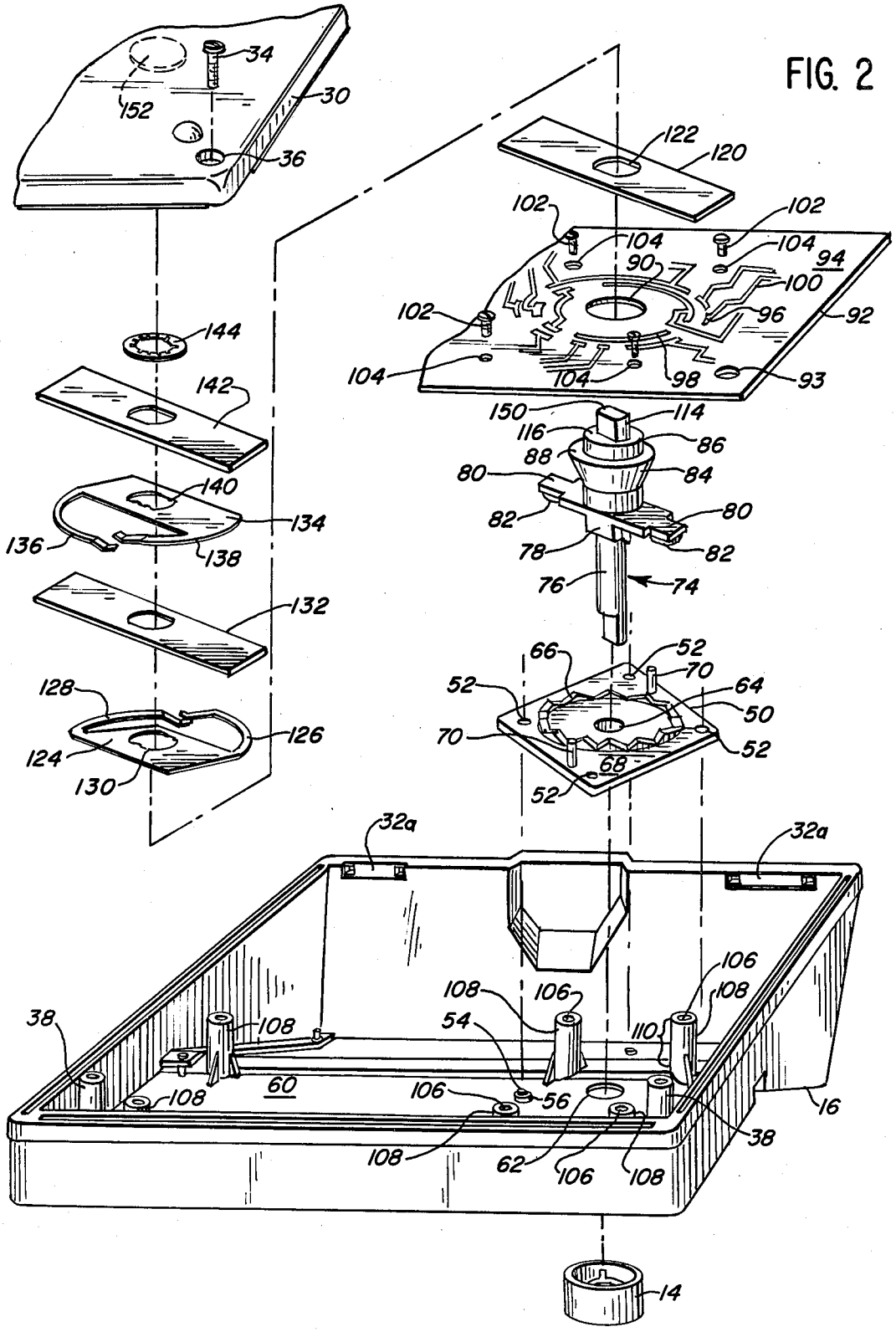
FIG. 2 is an inverted fragmentary perspective view of the switching mechanism of FIG. 1, shown in exploded relation from the underside of the housing.

With principal reference to FIGS. 2 and 3, the switch 10 comprises a plurality of component parts which cooperatively operate with a circuit board 92 and the upper housing 16 portion and a lower housing portion 30. The housing portions 16 and 30 are joined together by integrally formed hinges **32*a* and 32*b* and secured by engagement of a plurality of screws 34 which extend through holes 36 in portion 30 and engage bosses 38 extending from portion 16. This plurality of components is shown in exploded relation in FIG. 2. It should be noted that FIG. 2 shows the switch mechanism and housing portions 16 and 30** in inverted position.

More particularly, the switch mechanism 10 includes a detent plate 50 which is removably mounted to the housing portion 16 by engagement of four equally spaced holes 52, positioned at the corners of the substantially square detent plate 50, with nubs 54 extending from standoffs 56. The standoffs 56 are molded projections from the underside 60 of the housing portion 16 and are positioned equidistant from an opening 62 in such housing. The detent plate 50 includes a central hole 64 which is aligned with the opening 62 in the housing 16 when the detent plate 50 is in position in contact with the standoffs 56 and nubs 54. It should be noted here that the nubs 54 position the detent plate laterally of the housing 16 and the detent plate may be affixed to such nubs and the housing by expanding the ends of the nubs 54 through appropriate application of heat.

Arcuately disposed about the detent plate are a plurality of contiguous, V-shaped teeth 66 extending from the undersurface 68 of the detent plate. Posts 70 diametrically opposed across the hole 64 also extend from the undersurface 68 of the plate 50. As will be seen below, the V-shpaed teeth 66 posts 70 serve to establish stable rotational positions for the switch mechanism and to delimit its maximum arcuate travel, respectively. The detent plate may be selected with varying members of teeth 66 and varying positions for the posts 70 and it is contemplated that additional posts 70 may be employed.

Extending from the opposite side of the detent plate 50 is an annular collar 72 (best seen in FIG. 3) positioned about the hole 64. Such collar is of a predetermined length slightly less than the length of the standoffs 56 whereby the collar 72 does not engage the undersurface 60 of the housing 16 when the detent plate 50 is in position on the standoffs 56. In alternative embodiments of this invention wherein the standoffs are of lesser length and wherein the opening 62 in the housing portion 16 is of sufficient diameter, the collar 72 may extend into the opening 62.

A switch shaft 74, of insulating material, includes a substantially cylindrical portion 76 which extends through the hole 64 (and collar 72) and the opening 62 in the housing portion 16. So disposed, the shaft is rotatable about an axis at least partially established by sliding engagement of the portion 76 with the inner wall of the hole 64 (including the collar 72) in the detent plate 50. It should be observed that the shaft portion 76 is of a sufficient length to extend well beyond the upper surface of the housing 16 to engage in conventional fashion the aforementioned knob 14.

The shaft portion 76 adjoins a shaft portion 78 which includes a pair of opposed, resilient detent arms 80. The shaft 74 and arms 80 may be molded as one integral unit. The arms 80 each include a hemispherical detent nodule 82 extending from said arms, respectively, toward said V-shaped teeth 66 and positioned radially to engage said teeth.

The shaft portion 78 adjoins a frustoconical shaft portion 84 which, in turn, adjoins a cylindrical portion 86. At the junction of the portions 84 and 86, a flange 88 is formed. The portion 86 is of a diameter appropriate for extending through and slidably engaging the inner wall of a hole 90 in a circuit board 92 which rests against the flange 88. The board 92 includes holes 93 through which bosses 38 extend when the meter apparatus 12 is assembled.

An undersurface 94 of the circuit board 92 includes a plurality of arcuate terminal segments 96 and 98 formed of electrically conductive material circumferentially disposed about the hole 90. The discontiguous segments 98 are radially displaced outwardly from the hole 90 and the discontiguous segments 96 are radially displaced outwardly from the segments 98. Each of the segments 96 and 98 is electrically connected to a respective printed lead 100 which is connected to elements, not shown, of the circuitry of the meter apparatus 12.

Printed circuit board 92 is mounted to housing portion 16 by engagement of screws 102 through holes 104 in the printed circuit board with tapped holes 106 in bosses 108 extending fom the surface 60. The bosses 108 extend to a dimension 110 beneath the surface 60 of the housing portion 16 and are equidistant from the opening 62 in such housing portion.

The shaft portion 86 extends through and beyond the hole 90 in the circuit board 92 and adjoins a somewhat rectangular shaft portion 114. A flange 116 is formed at the junction of the shaft portions 114 and 86. An insulating spacer 120, including a central opening 122 adapted to engage the shaft portion 114, adjoins the flange 116. It should be observed that the cross-section of the shaft portion 114 and the opening 122 in the insulating spacer 120 cooperatively operate to prevent rotation of the spacer 120 with respect to the shaft 74.

A contact member 124, of electrically conductive material, immediately adjoins the spacer 120 on the shaft portion 114. The contact member 124 includes two arcuate contact arms 126 and 128,, respectively, which are adapted for engaging respective ones of the segments 96 and 98 on the printed circuit board 92. Specifically, the arm 126 is adapted for engaging respective segments 96, and the arm 128 is adapted for engaging respective segments 98. It should be noted that the contact element 124 also includes an opening 130 of the same configuration as the opening 122 which prevents rotational movement of the contact element 124 with respect to the shaft 74.

Immediately adjoining the contact element 124 on the shaft portion 114 is an insulating spacer 132 of the same type as the insulating spacer 120. The insulating spacer 132 serves to separate the contact member 124 from a contact member 134 which is similar to the contact member 124. The member 134 includes contact arms 136 and 138 disposed to the side opposite the arms 126 and 128 of the contact member 124. The contact arm 136 is disposed for engaging terminal segments 96 and the contact arm 138 is disposed for engaging segments 98.

A final insulating spacer 142, similar to the spacer 120, adjoins the contact member 134. The entire assembly is held in place by a press-nut 144 which, when placed in position on the shaft 114, holds the elements 120, 124, 132, 134, and 142 in position against the flange 116.

The shaft 74 terminates in a surface 150 which is adapted to engage a boss 152 (best seen in FIG. 3) extending upwardly from the inner surface 154 of the lower housing portion 30. Such boss extends from the surface 154 a distance just sufficient to engage the surface 150 in the absence of external forces, and provides means for abosrbing forces longitudinally applied to the shaft 74.

It should be observed that the flange 88 of the shaft 74 is held in contact with the printed circuit board 92 by spring action of the contact arms 126, 128, 136, and 138 acting against the segments 96 and 98 on the surface 94 of the printed circuit board.

It should be observed further that the detent plate 50 could be disposed on the opposite side of the printed circuit board provided, of course, that such elements as shaft 74 are appropriately adapted to accommodate the repositioning of the detent plate. Also, the printed circuit board could be equipped with a bearing surface in the aperture 90 if reduced rotational friction is desired.

In operation as the knob 14 is rotated manually, the contact arms 126 and 128 engage respective ones of the segments 96 and 98 making electrical contact therebetween. Substantially simultaneously contact arms 136 and 138 also engage respective ones of the segments 96 and 98 and make electrical contact therebetween. When rotational force is removed from the knob 14, the switch is maintained stably in its then existing position by the interaction of the nodules 82 with the respective teeth 66 with which they are then in contact. It should be observed that, should rotational force on knob 14 be sustained and the rotational position of the shaft 14 be changed sufficiently, the arms 80 engage the posts 70 and further rotation is inhibited thereby.

The above disclosed embodiment is illustrative. However, it is intended that the invention encompass all which falls within the true spirit and scope of the claims appended hereto.

What is claimed is:

1. A switch comprising:

housing means having a first wall and a second wall displaced from and substantially parallel to said first wall, said first wall having a first aperture therein;

printed circuit board means having a second aperture therein and contact elements disposed about said second aperture, said printed circuit board means being mounted in said housing between said first and second walls with said first and second apertures in substantial alignment;

shaft means extending through said first and second apertures, including resilient contact means for selectively engaging certain of said contact elements in response to rotational positioning of said shaft means, said shaft means including a portion extending to and abutting said second wall to transmit externally generated longitudinal forces directed along the axis of said shaft means toward said housing means to said second wall whereby stresses exerted on said printed circuit board are reduced;

rotation control means mounted to said housing means and including detent means and post means, said shaft means including radially extending arm means disposed to be engagable with said detent means for establishing a plurality of substantially stable rotational positions for said shaft means and with said post means for limiting the rotational travel of said shaft means, said rotation control means further including an annular collar for slidably engaging said shaft means, said annular collar being substantially aligned with said second aperture and cooperatively operating therewith to position said shaft means to thereby substantially establish the axis of rotation of said shaft means.

2. A switch as in claim 1 wherein said rotation control means is mounted between said first wall and said printed circuit board means and said contact elements and contact means are disposed on the side of said printed circuit board means opposite said rotation control means.

3. A switch comprising:

housing means having a first wall and a second wall displaced from and substantially parallel to said first wall, said first wall having a first aperture therein;

printed circuit board means having a second aperture therein and contact elements disposed about said second aperture, said printed circuit board means being mounted in said housing between said first and second walls with said first and second apertures in substantial alignment;

shaft means extending through said first and second apertures, including resilient contact means for selectively engaging certain of said contact elements in response to rotational positioning of said shaft means, said shaft means including a portion extending to and abutting said second wall to transmit externally generated longitudinal forces directed along the axis of said shaft means toward said housing means to said second wall whereby stresses exerted on said printed circuit board are reduced; and a plate mounted to said first wall, including a collar for slidably engaging said shaft means, said collar being substantially aligned with said second aperture in said printed circuit board and cooperatively operating therewith to position said shaft means to substantially establish the axis of rotation thereof.

4. A switch for use with a housing having a first wall and a second wall displaced from and substantially parallel to said first wall, said first wall having a first aperture therein, and a printed circuit board having a second aperture therein and contact elements disposed about said second aperture, said printed circuit board being mounted in said housing between said first and second walls with said first and second apertures in substantial alignment, comprising, shaft means extending through said first and second apertures, contact means connected to said shaft means for rotation therewith, said contact means selectively engaging certain ones of said contact elements, the selection depending upon the rotational position of said shaft means, said shaft means engaging said second wall of said housing to transmit to said housing the axial components of external forces applied to said shaft means toward said housing whereby stresses exerted on said printed circuit board are reduced, shaft control means mounted to said housing, including detent means and post means, said shaft means including radially extending arm means disposed to be engageable with said detent means for establishing a plurality of substantially stable rotational positions for said shaft means and with said post means for limiting the range of rotational movement of said shaft means, said shaft control means further including an annular collar for slidably engaging said shaft means, said collar being aligned with said second aperture to cooperatively position said shaft means to substantially establish the axis of rotation thereof.

5. A switch as in claim 4 wherein said shaft control means is adapted to be mounted between said first wall and said printed circuit board and said contact elements and said contact means are disposed on the side of such printed circuit board opposite said shaft control means.

* * * * *

UNITED STATES PATENT AND TRADEMARK OFFICE

CERTIFICATE OF CORRECTION

PATENT NO. : 4,232,207

DATED : November 4, 1980

INVENTOR(S) : Bernhard R. Kuhl and Edward J. Safranek

It is certified that error appears in the above-identified patent and that said Letters Patent are hereby corrected as shown below:

Column 2, line 22, FIG. 2 should start new paragraph.

Column 2, line 34, "4" should be --14--.

Column 3, line 17, "V-shpaed" should be --V-shaped--.

Column 3, line 17, after "66", insert --and--.

Column 4, line 6, "fom" should be --from--.

Column 4, line 57, "abosrbing" should be --absorbing--.

Column 5, line 48, "engagable" should be --engageable--.

Signed and Sealed this

*Twelfth* Day of *May 1981*

[SEAL]

*Attest:*

RENE D. TEGTMEYER

*Attesting Officer*

*Acting Commissioner of Patents and Trademarks*